US007367895B2

(12) United States Patent
Tseng

(10) Patent No.: US 7,367,895 B2
(45) Date of Patent: May 6, 2008

(54) SWING ASSEMBLY WITH DRAPES

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 11/181,061

(22) Filed: Jul. 14, 2005

(65) Prior Publication Data

US 2007/0015595 A1 Jan. 18, 2007

(51) Int. Cl.
*A63G 9/00* (2006.01)

(52) U.S. Cl. ..... 472/118; 472/125

(58) Field of Classification Search ..... 472/118, 472/125; 297/273, 245, 247
See application file for complete search history.

(56) References Cited

U.S. PATENT DOCUMENTS 795,711 A * 7/1905 Krieg, Sr. ..... 297/157.1
2,097,905 A * 11/1937 Weaver ..... 297/245
4,017,071 A * 4/1977 Wright ..... 472/118
4,784,383 A * 11/1988 Roberts ..... 472/125
5,902,187 A * 5/1999 Boring ..... 472/125
6,547,328 B2 * 4/2003 Liu ..... 297/245
6,648,768 B1 * 11/2003 Tseng ..... 472/118

* cited by examiner

*Primary Examiner*—Kien Nguyen
(74) *Attorney, Agent, or Firm*—Ladas & Parry LLP

(57) ABSTRACT

A swing assembly includes a main support frame and a swing chair unit. The main support frame includes four spaced-apart upright posts, and a top frame connected to the upright posts. The swing chair unit includes a suspending frame hung movably on the top frame, and a seat frame held by the suspending frame. The swing assembly further includes a roof assembly mounted on the top frame, and a drape assembly hung on the top frame and extending downwardly along and between the upright posts.

4 Claims, 10 Drawing Sheets

SWING ASSEMBLY WITH DRAPES

BACKGROUND OF THE INVENTION

1. Field of the Invention

The invention relates to a swing, more particularly to a swing assembly that has a stable support and that can prevent a user from being bitten by mosquitoes.

2. Description of the Related Art

Referring to FIG. 1, a conventional swing 1 comprises a top supporting frame 112, left and right leg units 111 mounted on the ground and connected to two opposite ends of the top supporting frame 112 using a plurality of screws 116, a swing chair assembly 12 hung on the top supporting frame 112, and a roof assembly 15 mounted on the top supporting frame 112. Each of the left and right leg units 111 includes a front leg rod 113, a rear leg rod 114, and two spaced-apart connecting rods 115 welded between the front and rear leg rods 113, 114. Top ends of the front and rear leg rods 113, 114 are positioned close to each other, while bottom ends thereof are spaced apart from each other so as to increase a supporting area of bottom portions of the left and right leg units 111 on the ground.

However, the distance between the bottom ends of the front and rear leg rods 113, 114 of each of the left and right leg units 111 is limited by the length of the front and rear leg rods 113, 114. That is, since the top ends of the front and rear leg rods 113, 114 must maintain their proximity to each other for a suitable length before the front and rear leg rods 113, 114 are gradually spaced apart from each other, the distance between the bottom ends of the front and rear leg rods 113, 114 is limited. Hence, the left and right leg units 111 cannot provide a good stable support, thereby rendering the substantially triangular configurations of the front and rear leg rods 113, 114 of the left and right leg units 111 suitable only for use in the conventional swing 1 with a relatively small overall size. Furthermore, the conventional swing 1 has no drape assembly that can prevent a user from being bitten by mosquitoes.

SUMMARY OF THE INVENTION

Therefore, the object of the present invention is to provide a swing assembly that has a stable support and that can be made to large sizes.

Another object of the present invention is to provide a swing assembly that has a drape assembly.

According to this invention, a swing assembly comprises a main support frame and a swing chair unit. The main support frame includes four spaced-apart upright posts, and a top frame connected to the upright posts. The swing chair unit includes a suspending frame hung movably on the top frame, and a seat frame held by the suspending frame.

Preferably, the swing assembly further comprises a roof assembly mounted on the top frame, and a drape assembly hung on the top frame and extending downwardly along and between the upright posts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
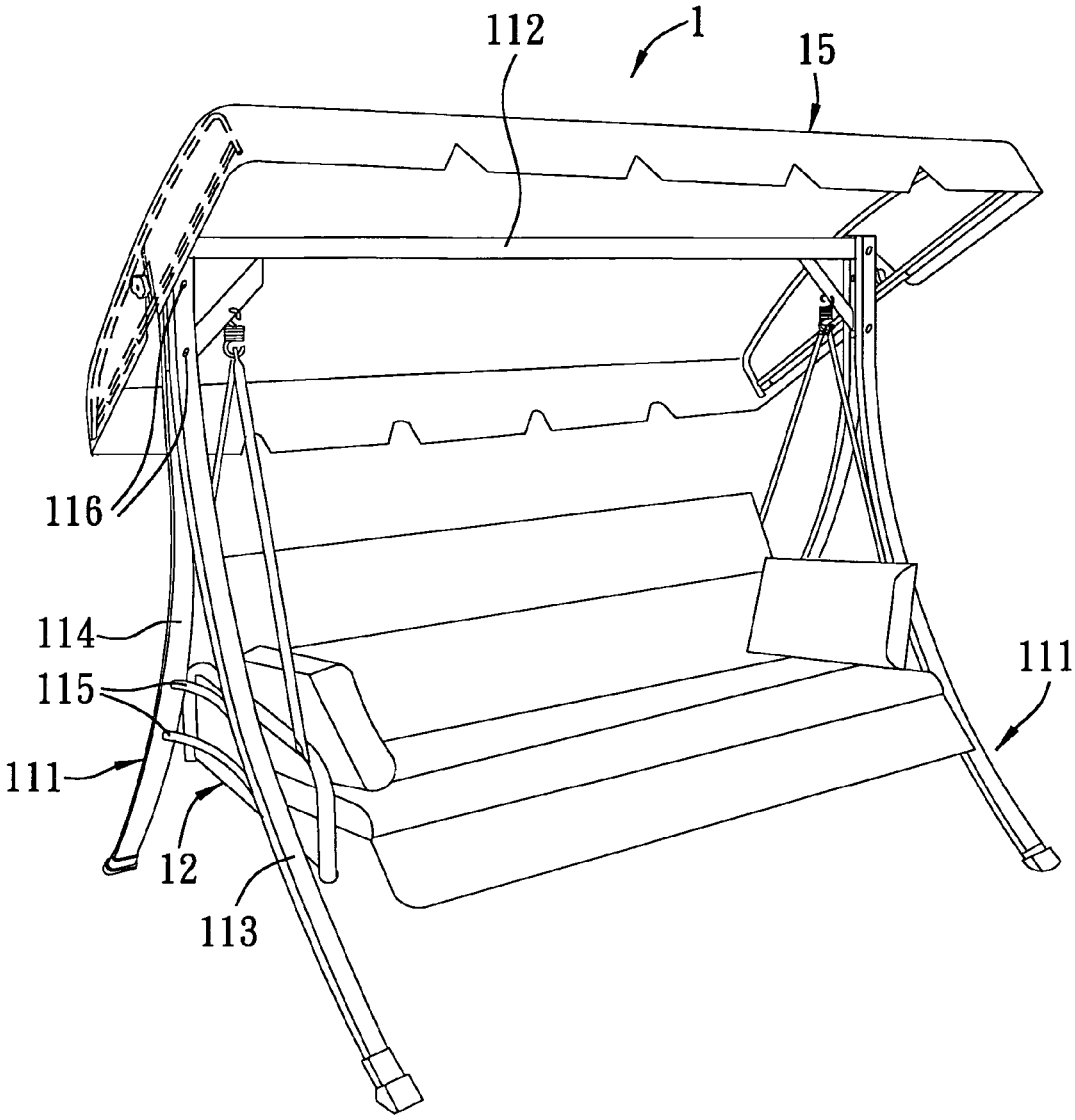
FIG. 1 PRIOR ART
FIG. 1 is a perspective view of a conventional swing.
Figure 2:
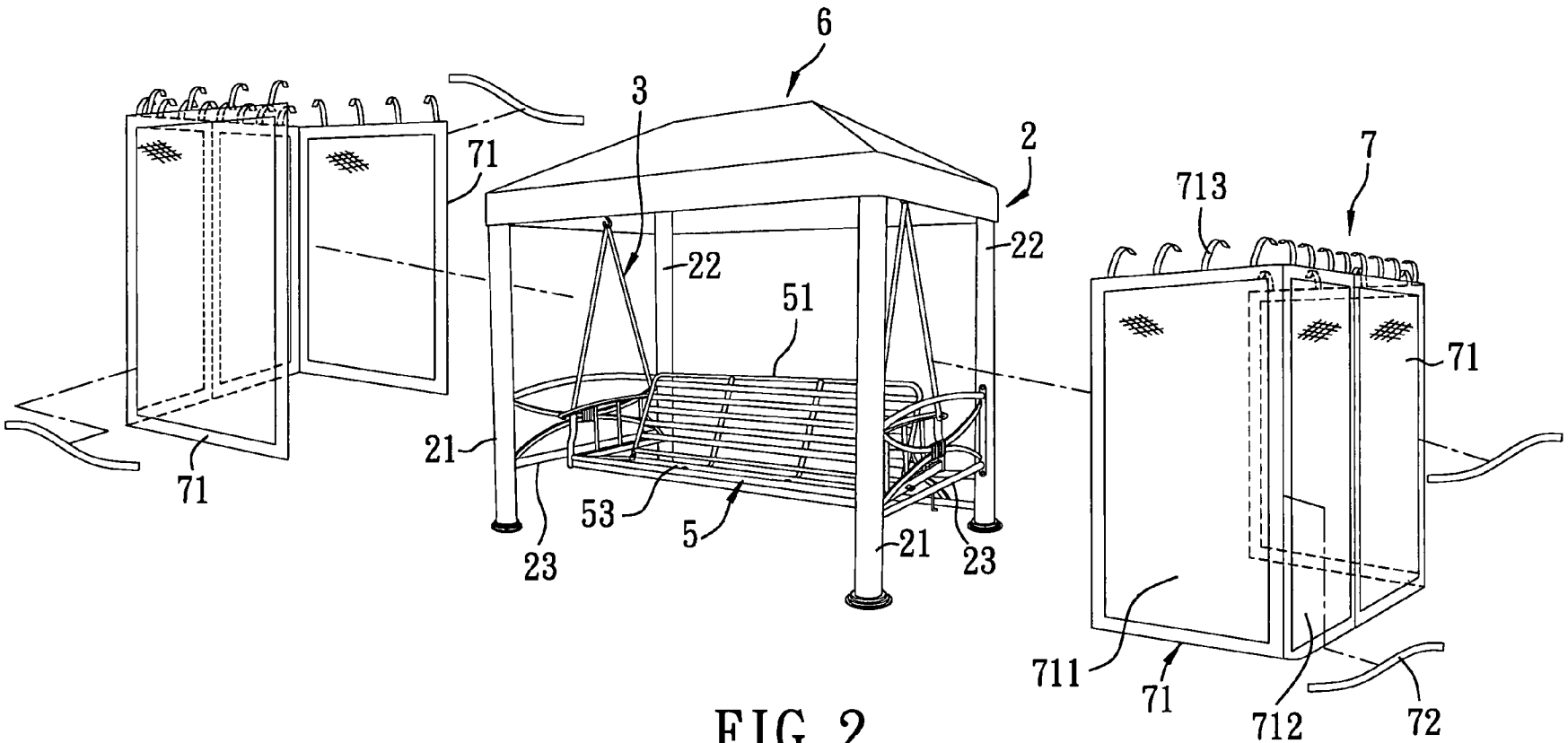
FIG. 2 is an exploded perspective view of the preferred embodiment of a swing assembly according to the present invention.

Referring to FIGS. 2 to 7, the preferred embodiment of a swing assembly according to the present invention is shown to comprise a main support frame 2, a swing chair unit 5, two retaining devices 4, a roof assembly 6, and a drape assembly 7.

The main support frame 2 includes left and right front upright posts 21, left and right rear upright posts 22, a left cross frame 23 connected between the left front and rear upright posts 21, 22, a right cross frame 23 connected between the right front and rear upright posts 21, 22, a rear cross frame 24 connected between the left and right rear upright posts 22 at bottom portions thereof, and a rectangular top frame 25 connected to the left and right front and rear upright posts 21, 22. The rear upright posts 22 are spaced apart from each other at a distance similar to that of the front upright posts 21. The top frame 25 includes four connectors 251 mounted on top of the respective front and rear upright posts 21, 22, four connecting rods 252 each connected between two adjacent ones of the connectors 251, a pair of horizontal cross rods 253 connected between two opposite ones of the connecting rods 252, and two spaced-apart supporting rods 254 connected between the horizontal cross rods 253. Each of the connectors 251 has a support bar 255 projecting inwardly and inclinedly therefrom. Each of the connecting rods 252 has a drape-hanging section 257. Each of the supporting rods 254 has an annular hanging plate 258 hung thereon.

The swing chair unit 5 is hung movably on the top frame 25, and includes a suspending frame 3 and a seat frame 9. The suspending frame 3 includes left and right suspending members 33 hooked respectively to the hanging plates 258 of the supporting rods 254, and a bottom support 32 supported by the left and right suspending members 33. Each of the left and right suspending members 33 has front and rear leg sections 31. The bottom support 32 includes left and right support rods 321, a front support rod 322 connected between front ends of the left and right support rods 321, a rear support rod 323 connected between rear ends of the left and right support rods 321, and left and right mounting plates 324 fixed respectively to inner sides of the left and right support rods 321. The front and rear leg sections 31 of the left suspending member 33 are connected to the front and rear ends of the left support rod 321. The front and rear leg sections 31 of the right suspending member 33 are connected to the front and rear ends of the right support rod 321.

The seat frame 9 is mounted on the bottom support 32, and includes a front section 53 and a rear section 51 connected pivotally to each other. The front section 53 has a front end rod 531 extending beyond the front support rod 322, a rear end rod 533 opposite to the front end rod 531, and left and right front seat rods 532 extending adjacent to the left and right support rods 321, respectively. The rear section 51 has a front end rod 513 connected pivotally to the rear end rod 533 of the front section 53 through two first pivot pins 54, a rear end rod 511 extending beyond the rear support rod 323, and left and right rear seat rods 512 connected pivotally and respectively to the left and right mounting plates 324 through two second pivot pins 52.

The seat frame 9 further includes an inclining device 55 (see FIGS. 5 and 6) for inclining the rear section 51 relative to the front section 53, and a seat cushion 56 (see FIG. 8) for covering the front and rear sections 53, 51. The inclining device 55 includes two positioning seats 551 (only one is visible) fixed to the rear support rod 323 and each having a positioning hole 553, an inclining member 552 pivoted to the left and right rear seat rods 512 (only the right rear rod 512 is visible) and engaged releasably to the positioning holes 553 in the positioning seats 551, and two enclosure members 554 (only one is visible) pivoted respectively to the positioning seats 551. Each of the enclosure members 554 covers openably the positioning hole 553 in the corresponding positioning seat 551.

Each of the retaining devices 4 (see FIGS. 3 and 7) is provided between the bottom support 32 and one of the left and right cross frames 23, and includes a hook-engaging member 43 fixed to a corresponding one of the left and right support rods 321 and having an engaging hole 431, a tube member 41 fixed to a corresponding one of the left and right cross frames 23, and a hook member 42 connected movably to the tube member 41 and engaged releasably to the hook-engaging member 43. When the hook member 42 is engaged to the engaging hole 431, the swing chair unit 5 is restricted from moving to and fro relative to the top frame 25. When the hook member 42 is disengaged from the engaging hole 431, the swing chair unit 5 can freely move to and fro.

Figure 3:
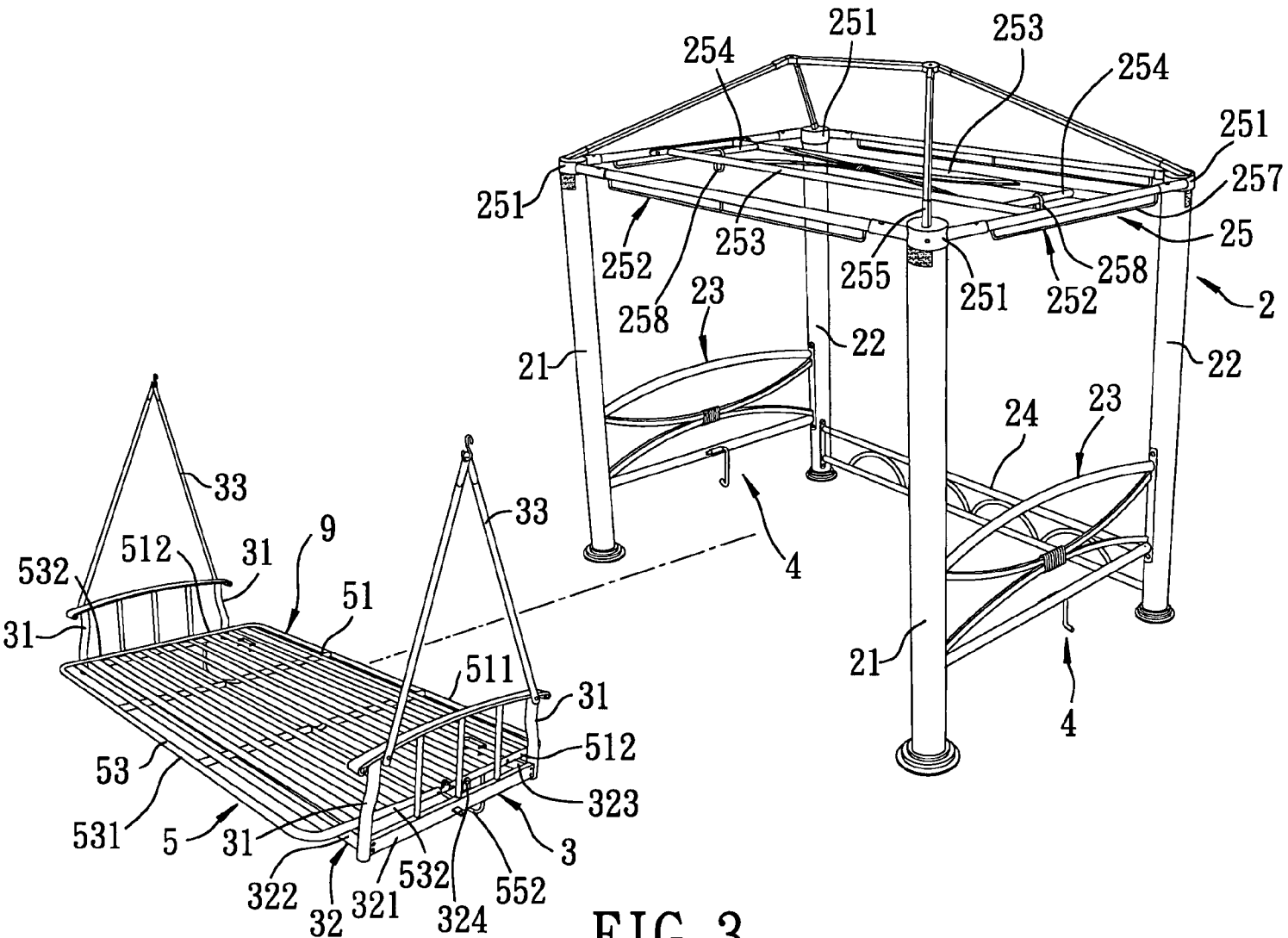
FIG. 3 is an exploded perspective view of a main support frame and a swing chair unit of the preferred embodiment.
Figure 5:
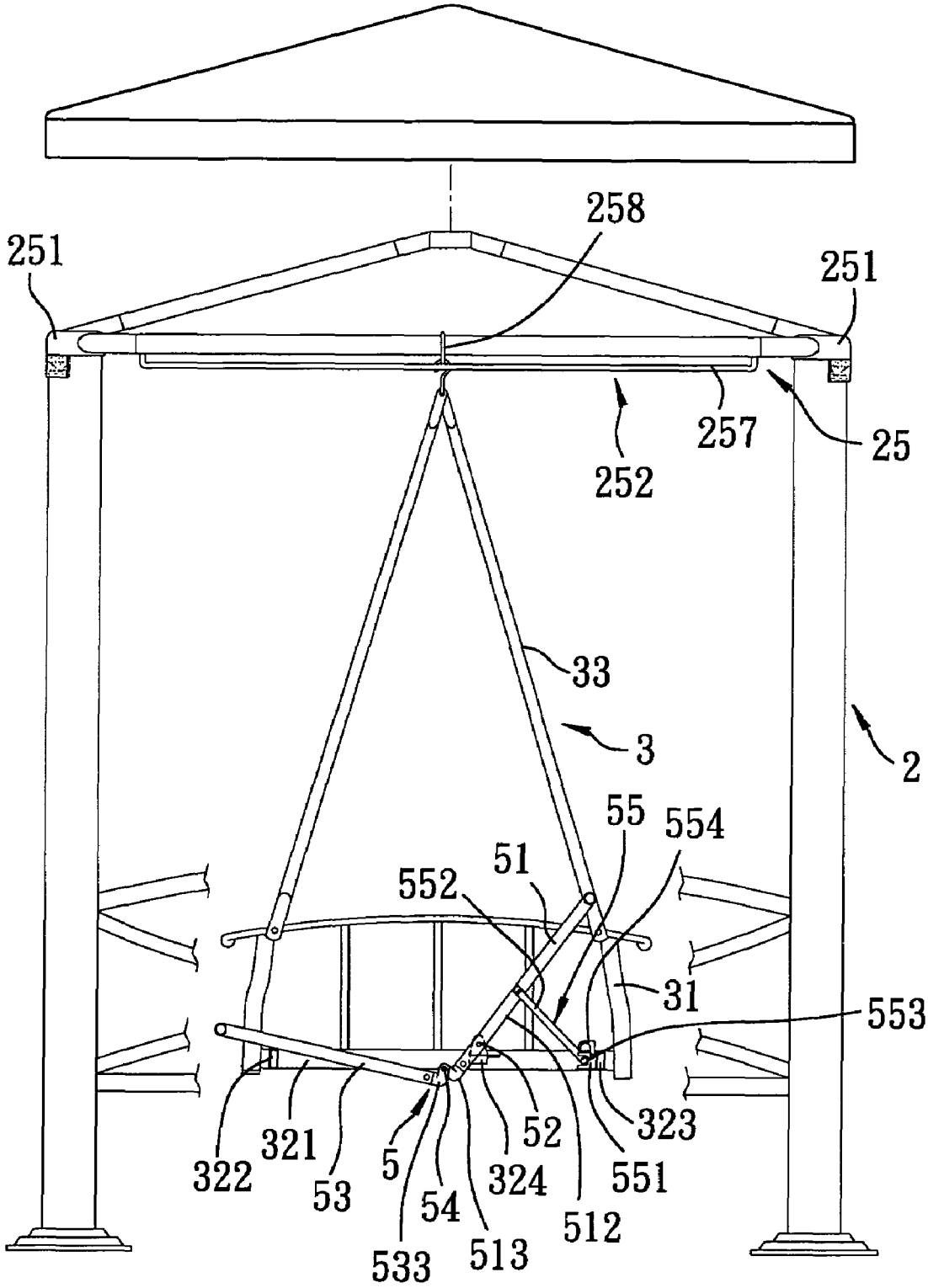
FIG. 5 is a schematic side view, which is used in describing assembly of the main support frame and the swing chair unit.
Figure 6:
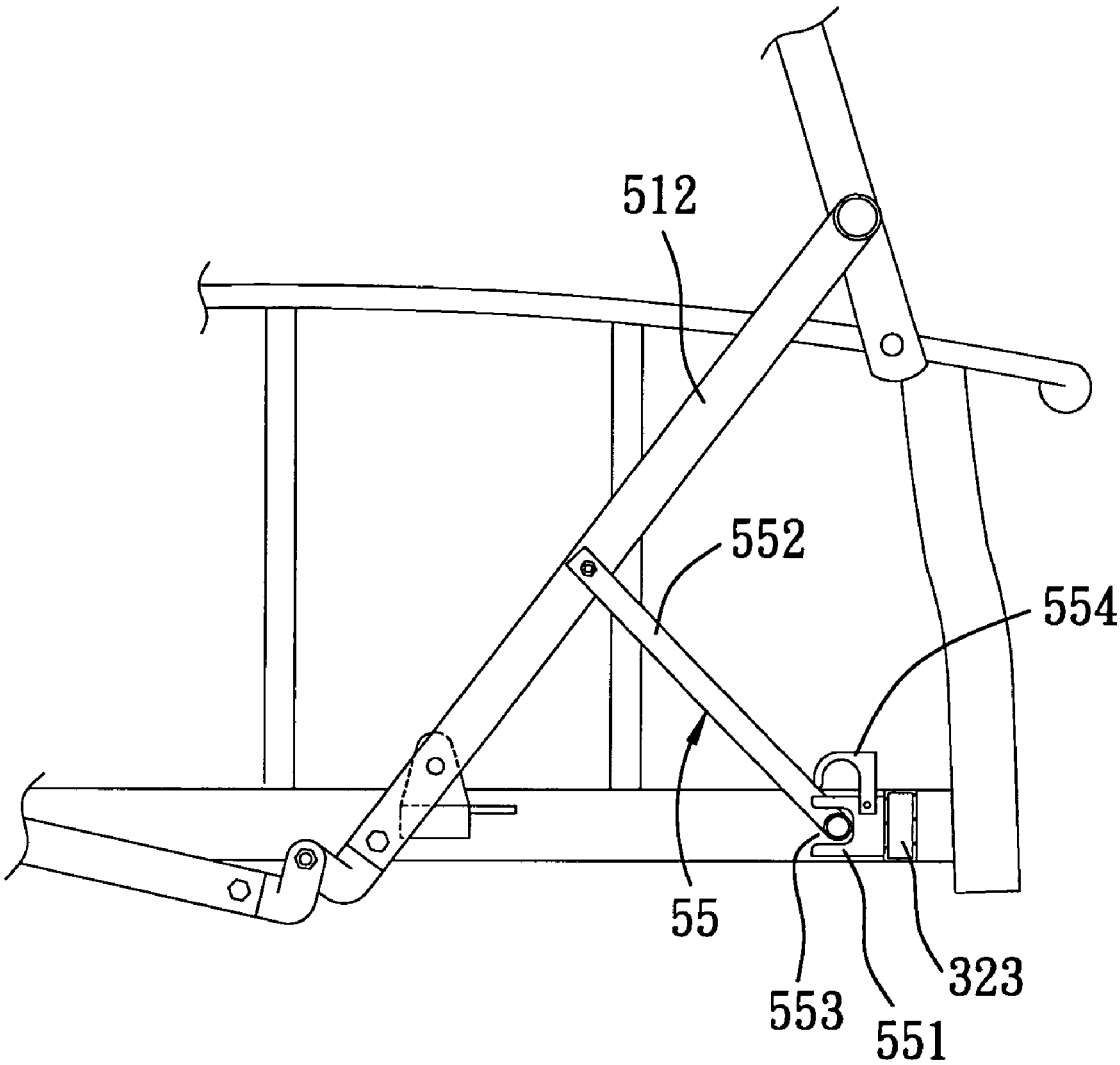
FIG. 6 is an enlarged fragmentary schematic view of FIG. 5.
Figure 7:
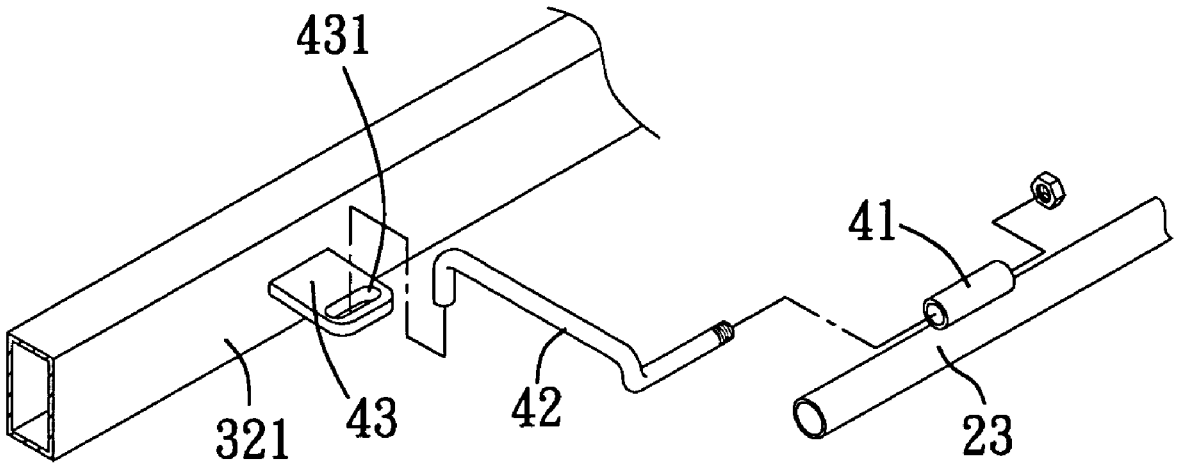
FIG. 7 is a fragmentary exploded perspective view showing a retaining device of the preferred embodiment.

When the rear section 51 of the seat frame 9 is disposed in an inclined position with respect to the front section 53, as shown in FIG. 5, the inclining member 552 is engaged to the positioning holes 553 in the positioning seats 551, and a user may be seated in a reclining manner on the seat cushion 56 (see FIG. 8) that covers the front and rear sections 53, 51 of the seat frame 9. When the inclining member 552 is disengaged from the positioning holes 553 in the positioning seats 551, the rear section 51 of the seat frame 9 can be pivoted downwardly so as to rest on the rear support rod 323 of the bottom support 32 so that the front and rear sections 53, 51 of the seat frame 9 lie flat on the bottom support 32, as shown in FIG. 3. The inclining member 552 is suspended downwardly at this time.

Figure 4:
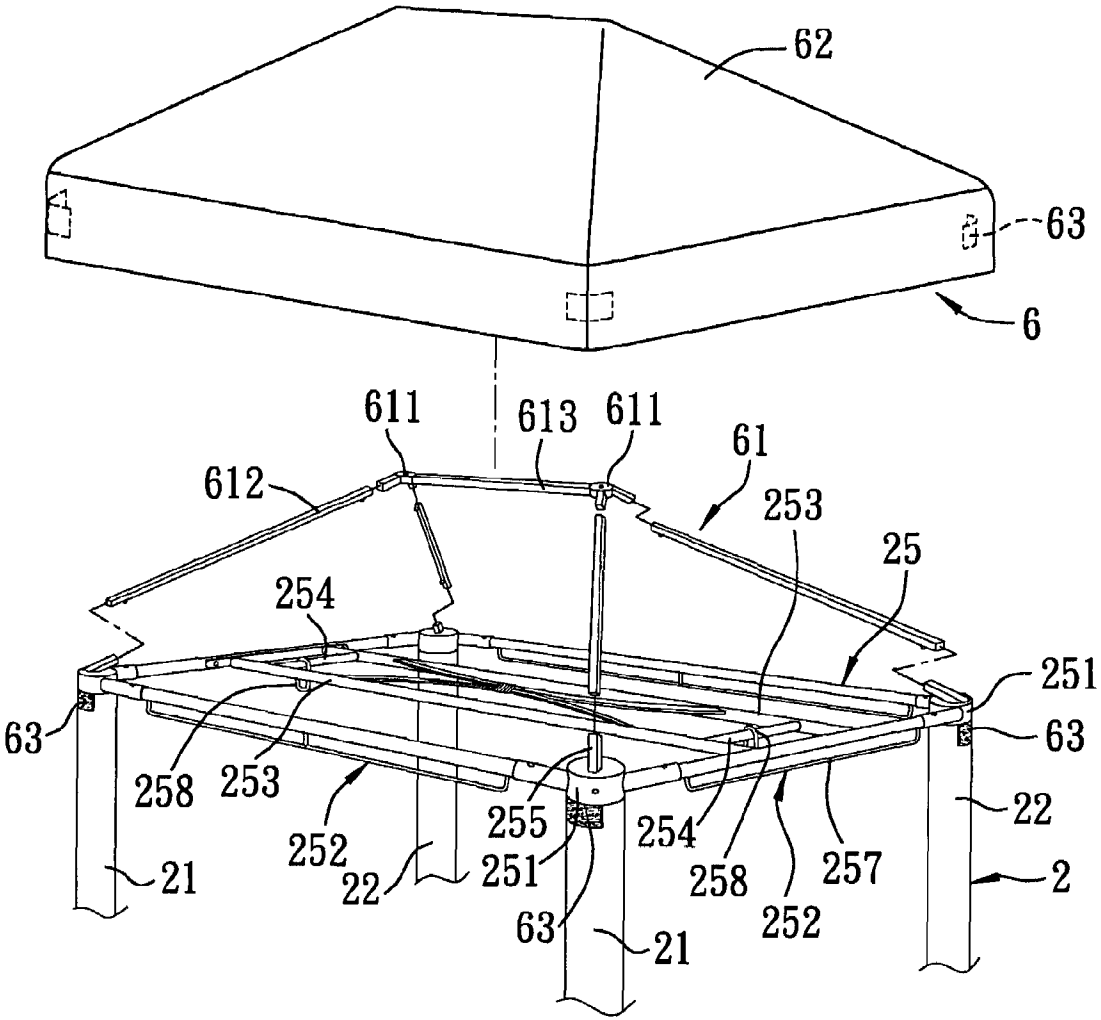
FIG. 4 is a fragmentary exploded perspective view of a roof assembly and a top frame of the main support frame of the preferred embodiment.

The roof assembly 6, as shown in FIGS. 3 and 4, is mounted on the top frame 25, and includes a roof frame 61, a covering 62 mounted on the roof frame 61, and a plurality of fastening units 63. The roof frame 61 has left and right connectors 611, four roof support rods 612 each connected between the corresponding support bar 255 and the corresponding connector 611, and a connecting rod 613 interconnecting the connectors 611. The fastening units 63 are configured as hook and loop fasteners, and are installed on the upright posts 21, 22 and four corners of the covering 62, so that the covering 62 can be connected detachably to the upright posts 21, 22 of the main support frame 2.

With reference to FIGS. 2, 3, 8, 9 and 10, the drape assembly 7 is hung on the top frame 25, and includes four drape members 71 hung movably on the corresponding drape-hanging sections 257 of the connecting rods 252 and surrounding the main support frame 2, and four tiebacks 72 for tying the drape members 71 to the corresponding upright posts 21, 22. Each of the drape members 71 has a netted first drape portion 711 disposed between the front or rear upright posts 21, 22, a netted second drape portion 712 disposed between two adjacent ones of the front and rear upright posts 21, 22, and a plurality of fastening straps 713 provided on top edges of the drape portions 711, 712. Each of the fastening straps 713 on the drape portions 711, 712 of each drape member 71 has hook and loop fasteners, and is looped around a corresponding one of the drape-hanging sections 257 of the connecting rods 252 prior to engagement so that the drape portions 711, 712 of each drape member 71 can be detachably hung on the corresponding drape-hanging sections 257.

Figure 8:
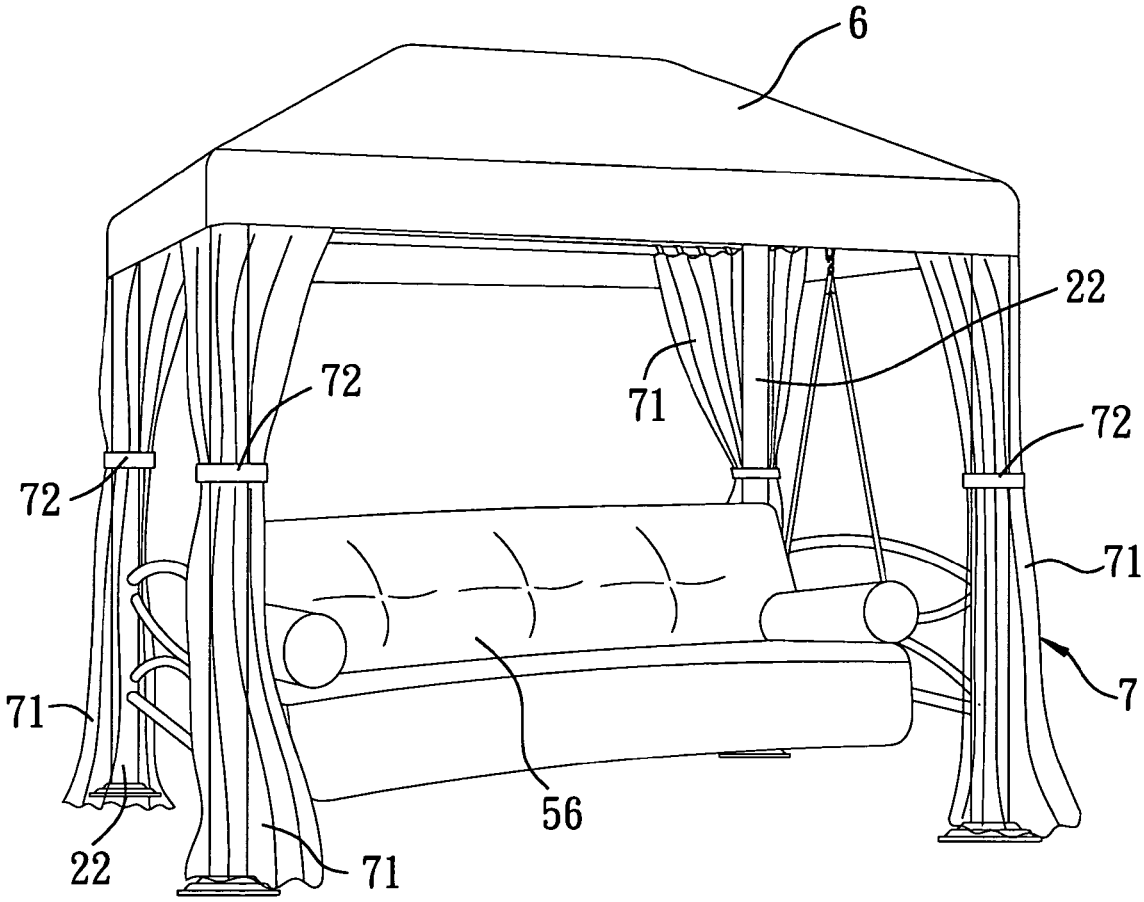
FIG. 8 is a perspective view of the preferred embodiment in an assembled state, illustrating a plurality of drape members tied to corresponding ones of the upright posts so as to be disposed in an opened position.

When the swing chair unit 5 is disposed in a swinging position, as shown in FIG. 8, the first and second drape portions 711, 712 (see FIG. 2) are moved toward the corresponding upright posts 21, 22, and are tied thereto by the corresponding tiebacks 72. At this time, the hook member 42 of the retaining device 4 is not engaged to the engaging hole 431 in the hook-engaging member 43 (see FIG. 7), and the seat frame 9 is disposed in the reclining position. The user can sit on the seat cushion 56, and swing the swing chair unit 5 to and fro.

When the swing chair unit 5 is to be disposed in a flat position, as shown in FIG. 3, the inclining member 552 is disengaged from the positioning seats 551 (see FIG. 5) so that the rear section 51 of the seat frame 9 can pivot rearwardly and downwardly so as to rest on the rear rod 323 of the bottom support 32, thereby placing the front and rear sections 53, 51 in a level position. The hook members 42 are subsequently engaged to the engaging holes 431 (see FIG. 7) so as to restrict to and fro movement of the swing chair unit 5 relative to the top frame 5. This facilitates lying on the seat frame 9 by the user.

Figure 9:
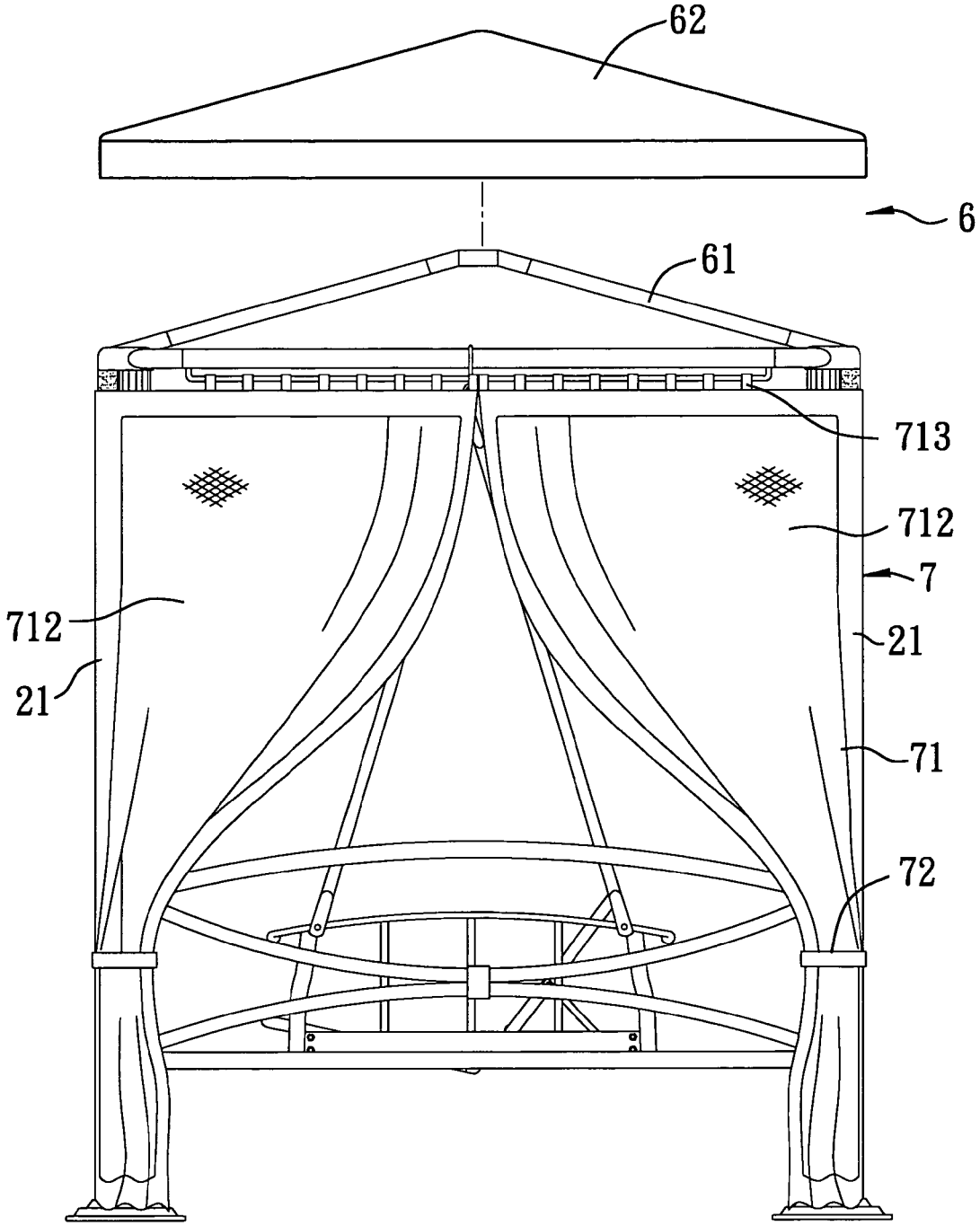
FIG. 9 is a view similar to FIG. 5, but with the drape members in a semi-opened position.
Figure 10:
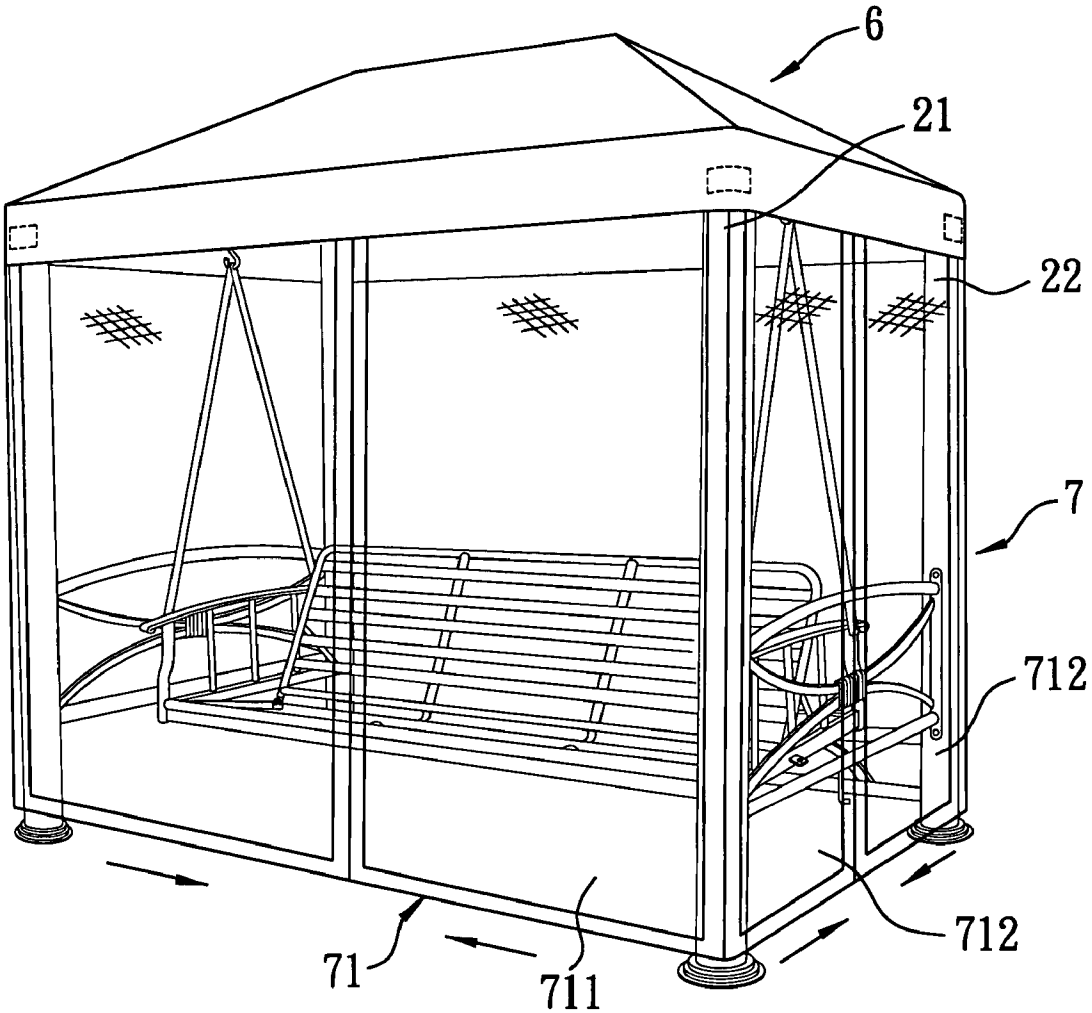
FIG. 10 is a view similar to FIG. 8, but with the drape members in a closed position.

Referring to FIGS. 9 and 10, to prevent the user from being bitten by mosquitoes, the tiebacks 72 are first untied from the corresponding upright posts 21, 22, after which the first drape portions 711 of the drape members 71 are pulled toward each other so as to be hung between the front and rear upright posts 21, 22, and the second drape portions 712 of the drape members 71 are pulled toward each other so as to be hung between two adjacent ones of the upright posts 21, 22. Hence, the entire main support frame 2 is surrounded by the first and second drape portions 711, 712 of the drape members 71.

From the aforementioned description, the swing assembly of the present invention is configured with the rectangular top frame 25 mounted on top of the four upright posts 21, 22 for hanging of the swing chair unit 5. Such a configuration can enhance stable to and fro swinging of the swing assembly. Furthermore, since the distance between each pair of the front and rear upright posts 21, 22 is similar over the entire lengths thereof, and the top frame 25 is fixed to the front and rear upright posts 21, 22, the structure of the present invention is very stable regardless of whether applied to a small- or large-type swing assembly. Moreover, the combination of the roof assembly 6 and the drape assembly 7 can ensure that the user will not be disturbed by mosquitoes in an outdoor setting.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing assembly comprising:

a main support frame including a plurality of spaced-apart upright posts, and a top frame connected to said upright posts; and a swing chair unit including a suspending frame hung movably on said top frame, and a seat frame held by said suspending frame;

a roof assembly mounted on said top frame; and a drape assembly hung on said top frame and extending downwardly along and between said upright posts to surround said swing chair unit;

wherein said top frame includes a plurality of connecting rods each connected between two adjacent ones of said upright posts, each of said connecting rods having a drape-hanging section;

wherein said drape assembly is not connected to said suspending frame so that said drape assembly is not movable along with said suspending frame, said drape assembly including a plurality of drape members hung movably on said drape-hanging sections of said connecting rods, each of said drape members having a bottom free and extending to a level proximate to bottom ends of said upright posts;

wherein each of said drape members has two drape portions which form a corner in proximity to one of said upright posts and which can be tied to said one of said upright posts to expose said swing chair unit, each of said drape portions of each of said drape members, when untied, can be pulled away from the corresponding one of said upright posts and toward one of said drape portions of an adjacent one of said drape members so as to entirely cover said swing chair unit.

2. The swing assembly of claim 1, wherein each of said drape members has a plurality of fastening straps attached movably to a corresponding one of said drape-hanging sections of said connecting rods.

3. The swing assembly of claim 1, wherein said roof assembly includes a roof frame mounted on said upright posts, a covering supported by said roof frame, and a plurality of fastening units for fastening detachably said covering to said upright posts.

4. The swing assembly of claim 1, wherein said drape assembly further includes a plurality of tiebacks for tying said drape members to the corresponding ones of said upright posts.

* * * * *